US006749187B2

(12) United States Patent
Yang

(10) Patent No.: US 6,749,187 B2
(45) Date of Patent: Jun. 15, 2004

(54) SHOCK-ABSORBING STRUCTURE FORMED BY PLASTIC MATERIAL

(76) Inventor: Teng-Jen Yang, No. 13, Alley 2, Lane 67, Ji Feng Rd., Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/305,851

(22) Filed: Nov. 27, 2002

(65) Prior Publication Data

US 2004/0094881 A1 May 20, 2004

(30) Foreign Application Priority Data

Nov. 18, 2002 (TW) ..... 91218489 U

(51) Int. Cl.[7] ..... F16F 7/00

(52) U.S. Cl. ..... 267/141; 267/249; 267/141.4; 36/28

(58) Field of Search ..... 267/141, 249, 267/238, 257, 290, 141.1, 141.2, 141.4, 142, 182; 36/27, 28, 114, 88, 37, 69

(56) References Cited

U.S. PATENT DOCUMENTS 4,235,427 A * 11/1980 Bialobrzeski ..... 267/153
4,535,553 A * 8/1985 Derderian et al. ..... 36/28
4,817,921 A * 4/1989 Stevenson ..... 267/33
5,239,737 A * 8/1993 Balsells ..... 29/896.9
5,364,086 A * 11/1994 Paton ..... 267/140.4
5,868,384 A * 2/1999 Anderson ..... 267/141.1
6,006,449 A * 12/1999 Orlowski et al. ..... 36/27
6,237,901 B1 * 5/2001 Bianchi ..... 267/33
6,457,261 B1 * 10/2002 Crary ..... 36/27
D476,474 S * 7/2003 McDowell ..... D2/972

FOREIGN PATENT DOCUMENTS

JP 61290245 A * 12/1986

* cited by examiner

*Primary Examiner*—Pam Rodriguez
(74) *Attorney, Agent, or Firm*—Charles E. Baxley

(57) ABSTRACT

A shock-absorbing structure includes an elastic helical body, and an elastic helical curved tube. The elastic helical body is formed with a plurality of loops and a plurality of buffer spaces each defined between any two adjacent loops. The elastic helical curved tube is formed with a plurality of curved convex portions each inserted into a respective buffer space and urged between any two adjacent loops. Thus, the buffer spaces of the elastic helical body provide a cushioning effect. In addition, the elastic helical body and the elastic helical curved tube produce an elastic restoring force, so as to damp and reduce the stress applied on the shoe sole, thereby providing a shock-absorbing effect.

3 Claims, 5 Drawing Sheets

SHOCK-ABSORBING STRUCTURE FORMED BY PLASTIC MATERIAL

BACKGROUND OF THE INVENTION

1. Field of the Invention

The present invention relates to a shock-absorbing structure formed by plastic material, and more particularly to a shock-absorbing structure having a shock-absorbing effect and a cushioning effect.

2. Description of the Related Art

A conventional shock-absorbing structure in accordance with the prior art shown in FIG. 1 is mounted in a shoe sole 10, and comprises a plurality of air chambers 11 and a plurality of rubber columns 12. Thus, the conventional shock-absorbing structure provides a shock-absorbing effect. However, the restoring effect of the rubber columns 12 is limited, and the deformable space of the air chambers 11 is also limited. In addition, the stress is excessively concentrated on the rubber columns 12, so that the rubber columns 12 are easily deformed or broken. Further, when the air chambers 11 are worn out, the shock-absorbing effect of the conventional shock-absorbing structure fails.

SUMMARY OF THE INVENTION

The present invention has arisen to mitigate and/or obviate the disadvantage of the conventional shock-absorbing structure.

The primary objective of the present invention is to provide a shock-absorbing structure having a shock-absorbing effect and a cushioning effect.

Another objective of the present invention is to provide a shock-absorbing structure formed by plastic material, wherein the buffer spaces of the elastic helical body provide a deformable and compressible space efficiently, so as to damp and reduce the stress applied on the shoe sole, thereby providing a cushioning effect.

A further objective of the present invention is to provide a shock-absorbing structure formed by plastic material, wherein the plurality of loops of the elastic helical body produce an elastic restoring force, and the curved convex portions and curved concave portions of the elastic helical curved tube also produce an elastic restoring force, so as to damp and reduce the stress applied on the shoe sole, thereby providing a shock-absorbing effect.

A further objective of the present invention is to provide a shock-absorbing structure formed by plastic material, wherein the softer elastic helical curved tube balances and buffers the compression stress efficiently, so as to protect the harder elastic helical body.

A further objective of the present invention is to provide a shock-absorbing structure formed by plastic material, wherein the curved convex portions and curved concave portions of the elastic helical curved tube distribute and reduce the compression stress on the loops at the compressed side of the elastic helical body, thereby preventing the loops at the compressed side of the elastic helical body from being torn and broken.

In accordance with the present invention, there is provided a shock-absorbing structure formed by plastic material, comprising an elastic helical body, and an elastic helical curved tube combined with the helical body, wherein:

the elastic helical body is formed with a plurality of loops, and a plurality of buffer spaces each defined between any two adjacent loops; and the elastic helical curved tube is formed with a plurality of curved convex portions each inserted into a respective one of the buffer spaces of the elastic helical body and urged between any two adjacent loops of the elastic helical body.

Further benefits and advantages of the present invention will become apparent after a careful reading of the detailed description with appropriate reference to the accompanying drawings.

DETAILED DESCRIPTION OF THE INVENTION

Figure 1:
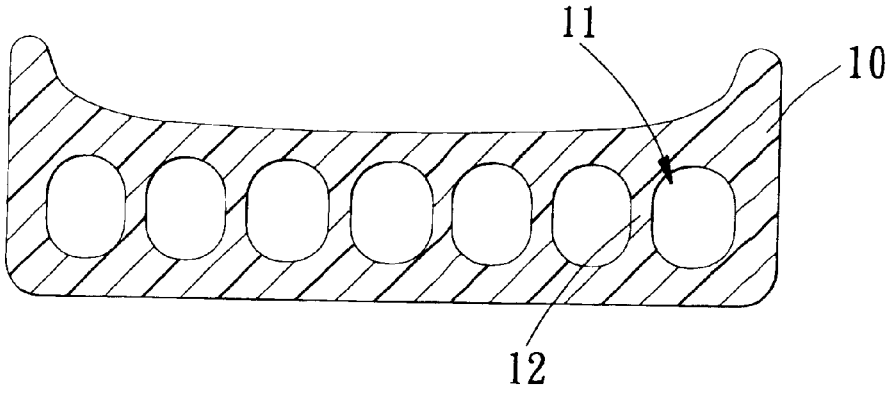
F I G. 1 PRIOR ART
FIG. 1 is a plan cross-sectional view of a conventional shock-absorbing structure in accordance with the prior art.
Figure 2:
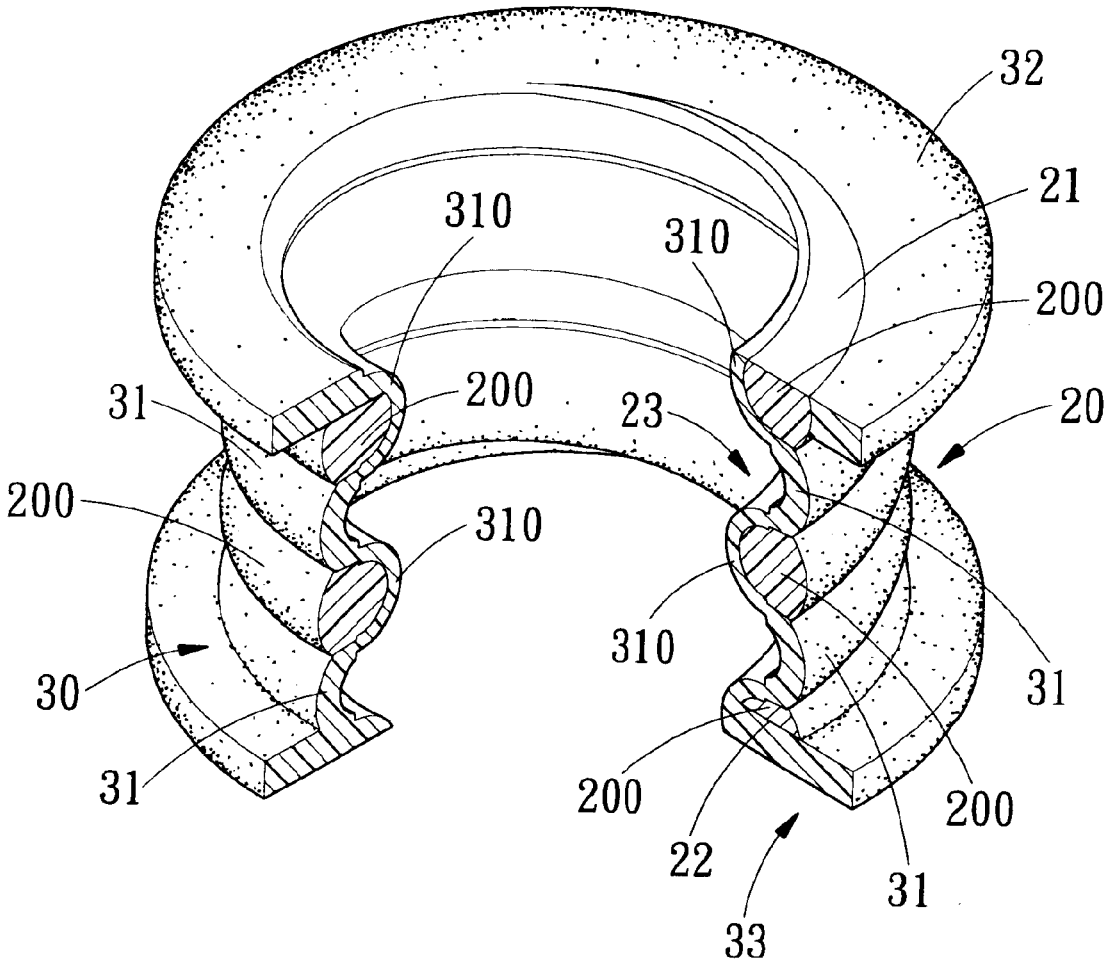
FIG. 2 is a partially cut-away perspective cross-sectional view of a shock-absorbing structure formed by plastic material in accordance with a preferred embodiment of the present invention.
Figure 3:
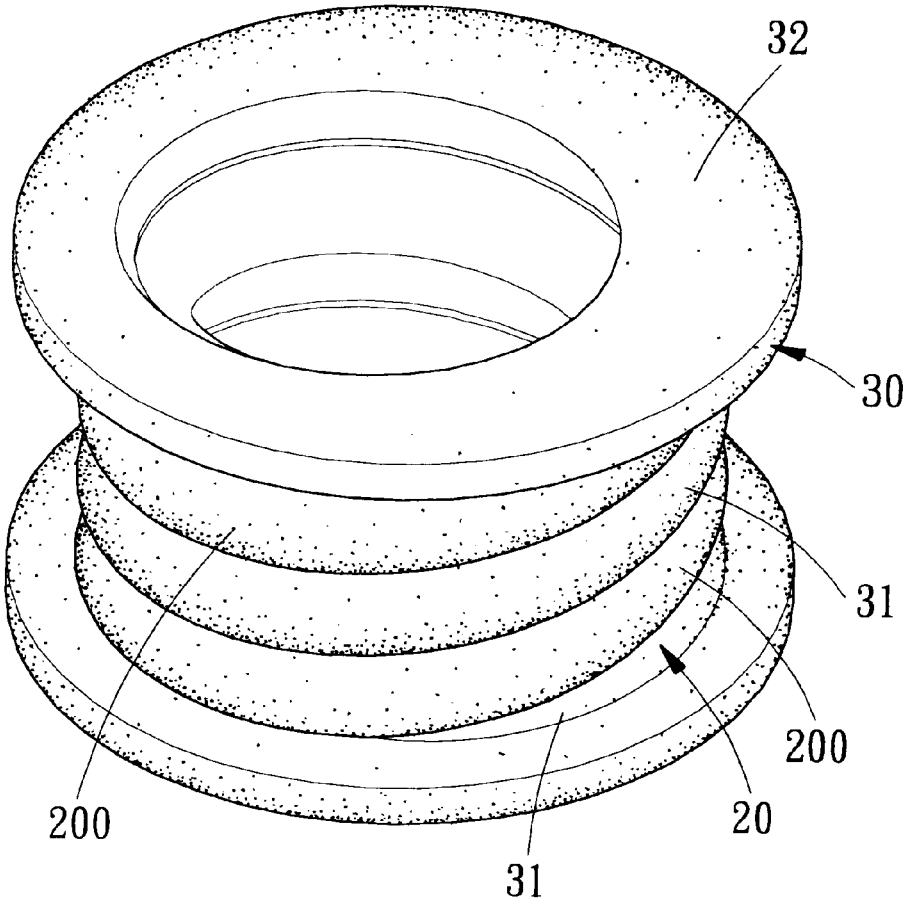
FIG. 3 is a perspective view of the shock-absorbing structure formed by plastic material in accordance with the preferred embodiment of the present invention.
Figure 4:
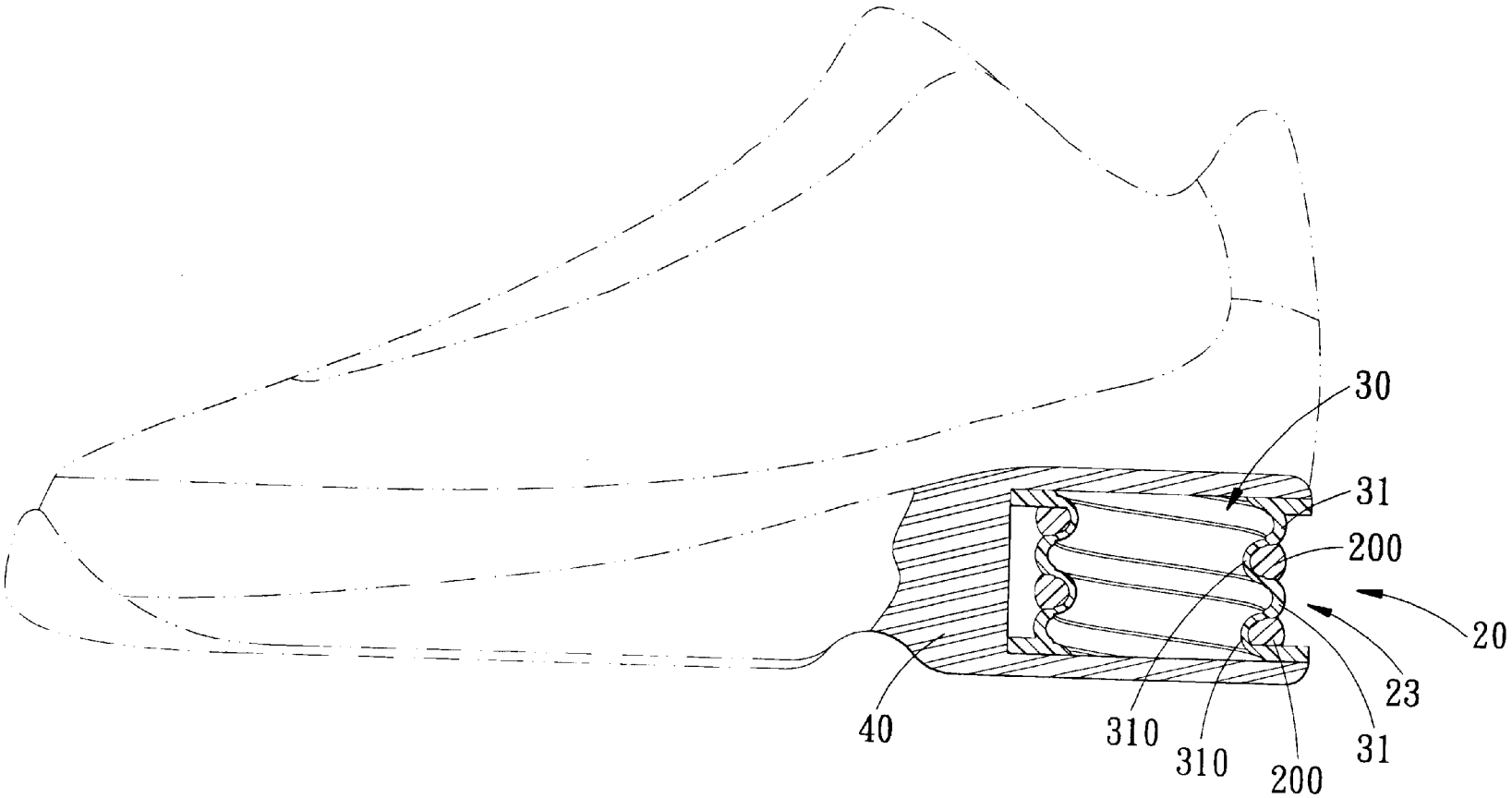
FIG. 4 is a partially plan cross-sectional assembly view showing the shock-absorbing structure being mounted in a shoe sole.

Referring to the drawings and initially to FIGS. 2–4, a shock-absorbing structure formed by plastic material in accordance with a preferred embodiment of the present invention comprises an elastic helical body 20, and an elastic helical curved tube 30 combined with the helical body 20.

The elastic helical body 20 is made of a harder elastic plastic material. The elastic helical body 20 has a shape of a curved helical spring, and is formed with a plurality of loops 200 which are connected and arranged in a helical manner. The elastic helical body 20 is formed with a plurality of buffer spaces 23 each defined between any two adjacent loops 200. The elastic helical body 20 has a flattened upper end face 21 and a flattened lower end face 22.

The elastic helical curved tube 30 is made of a softer elastic plastic material. The elastic helical curved tube 30 is mounted in an inner periphery of the elastic helical body 20. Preferably, the elastic helical curved tube 30 is combined with the elastic helical body 20 integrally by a plastic injection molding process. The elastic helical curved tube 30 is formed with a plurality of curved convex portions 31 each inserted into a respective one of the buffer spaces 23 of the elastic helical body 20 and urged between any two adjacent loops 200 of the elastic helical body 20. The elastic helical curved tube 30 is formed with a plurality of curved concave portions 310 each encompassing a respective one of the loops 200 of the elastic helical body 20. Each of the curved concave portions 310 is located between any two adjacent curved convex portions 31 of the elastic helical curved tube 30. The curved convex portions 31 and the curved concave portions 310 of the elastic helical curved tube 30 are connected and arranged in a helical manner. The elastic helical curved tube 30 has a flattened upper end face 32 flush with the flattened upper end face 21 of the elastic helical body 20 and a flattened lower end face flush with the flattened lower end face 22 of the elastic helical body 20.

In application, the shock-absorbing structure of the present invention is mounted in a shoe sole 40 as shown in FIG. 4. When the shoe sole 40 is subjected to a compression stress, the flattened upper end face 21 of the elastic helical body 20 and the flattened upper end face 32 of the elastic helical curved tube 30 withstand the stress simultaneously. Thus, the buffer spaces 23 of the elastic helical body 20 provide a deformable and compressible space efficiently, so as to damp and reduce the stress applied on the shoe sole 40, thereby providing a cushioning effect.

At the same time, the plurality of loops 200 of the elastic helical body produce an elastic restoring force, and the curved convex portions 31 and curved concave portions 310 of the elastic helical curved tube 30 also produce an elastic restoring force, so as to damp and reduce the stress applied on the shoe sole 40, thereby providing a shock-absorbing effect.

Figure 5:
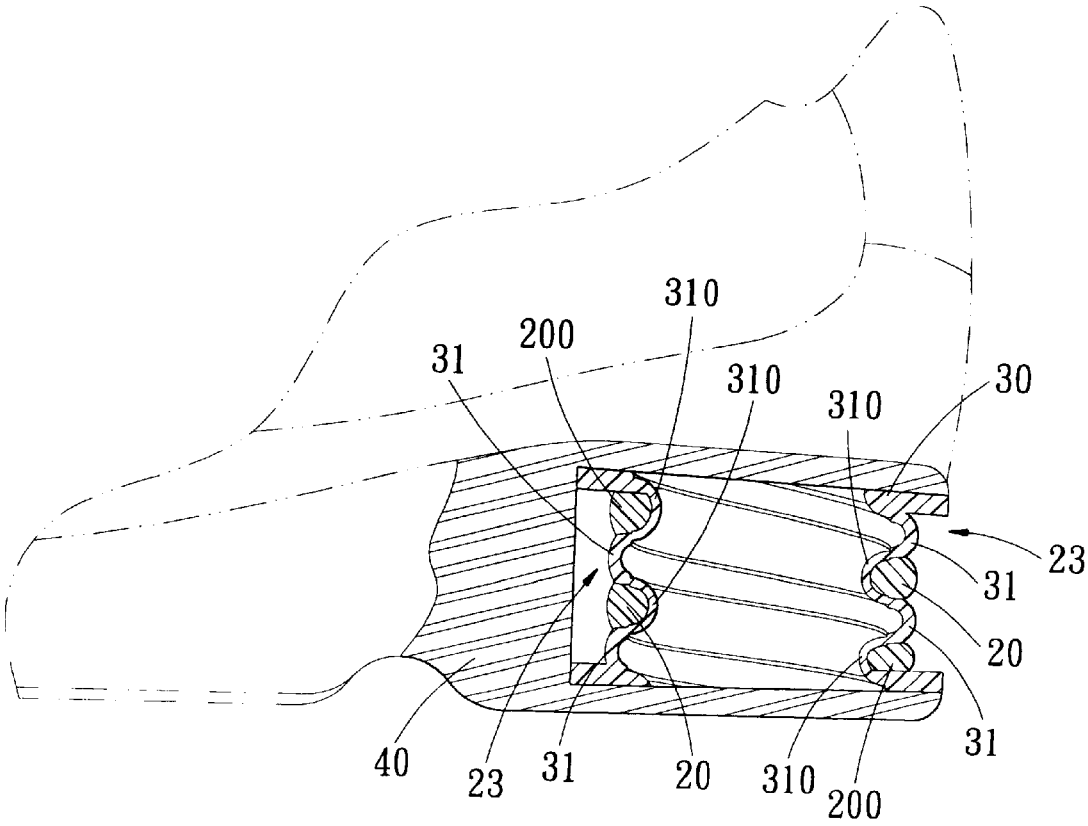
FIG. 5 is a schematic operational view of the shock-absorbing structure as shown in FIG. 4 in compression.

Referring to FIG. 5, when the shoe sole 40 is subjected to an unevenly distributed compression stress, the elastic helical body 20 and the elastic helical curved tube 30 withstand the unevenly distributed compression stress simultaneously. At this time, the buffer spaces 23 at one side of the elastic helical body 20 are compressed and shortened, while the buffer spaces 23 at the other side of the elastic helical body 20 are stretched and lengthened. Similarly, the curved convex portions 31 and curved concave portions 310 at one side of the elastic helical curved tube 30 are compressed and deformed, the curved convex portions 31 and curved concave portions 310 at the other side of the elastic helical curved tube 30 are stretched and deformed.

In such a manner, the elastic helical body 20 and the elastic helical curved tube 30 at the compressed side withstand the compression stress simultaneously, while the curved convex portions 31 and curved concave portions 310 at the other side of the elastic helical curved tube 30 produce a support pulling force on the loops 200 at the other side of the elastic helical body 20, thereby distributing and reducing the compression stress of the compressed side.

Accordingly, the softer elastic helical curved tube 30 balances and buffers the compression stress efficiently, so as to protect the harder elastic helical body 20. In addition, the curved convex portions 31 and curved concave portions 310 of the elastic helical curved tube 30 distribute and reduce the compression stress on the loops 200 at the compressed side of the elastic helical body 20, thereby preventing the loops 200 at the compressed side of the elastic helical body 20 from being torn and broken.

While the preferred embodiment(s) of the present invention has been shown and described, it will be apparent to those skilled in the art that various modifications may be made in the embodiment(s) without departing from the spirit of the present invention. Such modifications are all within the scope of the present invention.

What is claimed is:

1. A shock-absorbing structure formed by plastic material, comprising an elastic helical body, and an elastic helical curved tube combined with the helical body, wherein:

the elastic helical body is formed with a plurality of loops, and a plurality of buffer spaces each defined between any two adjacent loops; and the elastic helical curved tube is formed with a plurality of curved convex portions each inserted into a respective one of the buffer spaces of the elastic helical body and urged between any two adjacent loops of the elastic helical body; the elastic helical curved tube formed with a plurality of curved concave portions each encompassing a respective one of the loops of the elastic helical body.

2. The shock-absorbing structure formed by plastic material in accordance with claim 1, wherein each of the curved concave portions is located between any two adjacent curved convex portions of the elastic helical curved tube.

3. The shock-absorbing structure formed by plastic material in accordance with claim 1, wherein the curved convex portions and the curved concave portions of the elastic helical curved tube are connected and arranged in a helical manner.

* * * * *